United States Patent [19]

Lembeck

[11] Patent Number: 4,650,083

[45] Date of Patent: Mar. 17, 1987

[54] SAFETY CLOSURE FOR USE IN CONJUNCTION WITH BOTTLING OF CHAMPAGNE AND OTHER SPARKLING WINES

[76] Inventor: William Lembeck, 54 Continental Ave., Forest Hills, N.Y. 11375

[21] Appl. No.: 741,848

[22] Filed: Jun. 6, 1985

[51] Int. Cl.[4] ..... B65D 51/16

[52] U.S. Cl. ..... 215/307

[58] Field of Search ..... 215/307; 220/367; 426/118

[56] References Cited

U.S. PATENT DOCUMENTS

| | | | |
|---|---|---|---|
| 1,087,840 | 2/1914 | Simmons | 215/307 |
| 1,188,031 | 6/1916 | Behrens | 215/307 |

FOREIGN PATENT DOCUMENTS

| | | | |
|---|---|---|---|
| 200946 | 5/1958 | Australia | 215/307 |
| 1229928 | 3/1960 | France | 215/307 |

*Primary Examiner*—Donald F. Norton
*Attorney, Agent, or Firm*—Philip D. Amins

[57] ABSTRACT

The present invention pertains to a safety closure for a sparkling wine bottle which closure comprises a specially constructed cork member having a head portion, a base portion and a stem or shank portion interposed between said head and base portions with the base portion being provided with gas pervious means to permit the passage of pressurized gas from beneath the base portion, past the shank portion and then outwardly of the opening in the neck of the bottle. The foregoing is the structure by which the pressurized gas is safely and effectively dispelled from the bottle while concomitantly providing the aural popping associated with the opening of a bottle of sparkling wine but preventing the forcible propulsion of the cork member outwardly of the bottle, due to the frictional engagement of the base portion with the neck of the bottle.

16 Claims, 18 Drawing Figures

FIG. 1
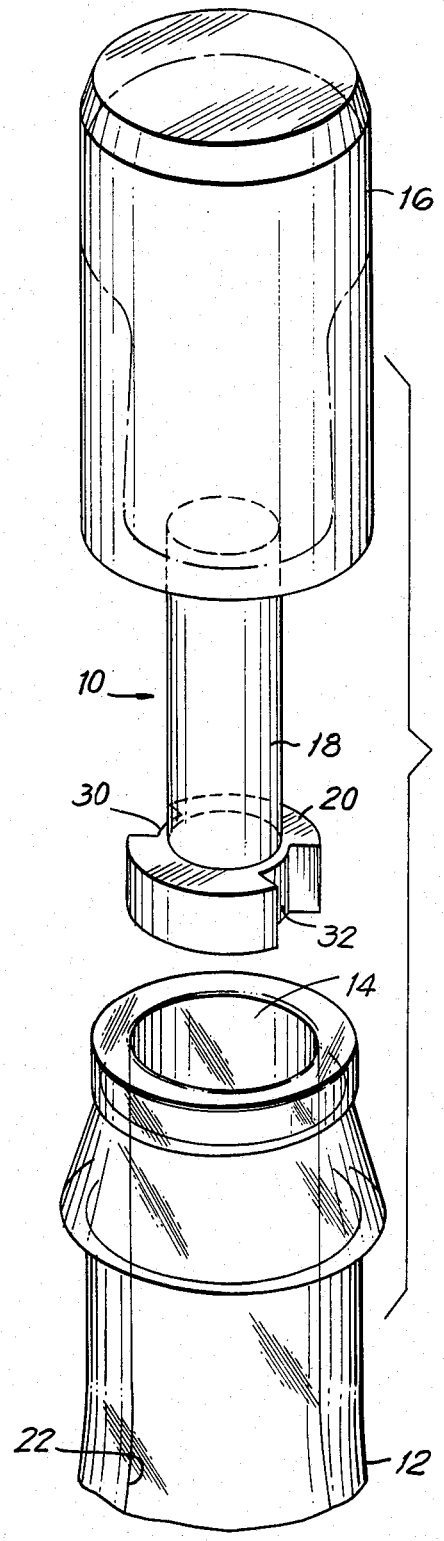
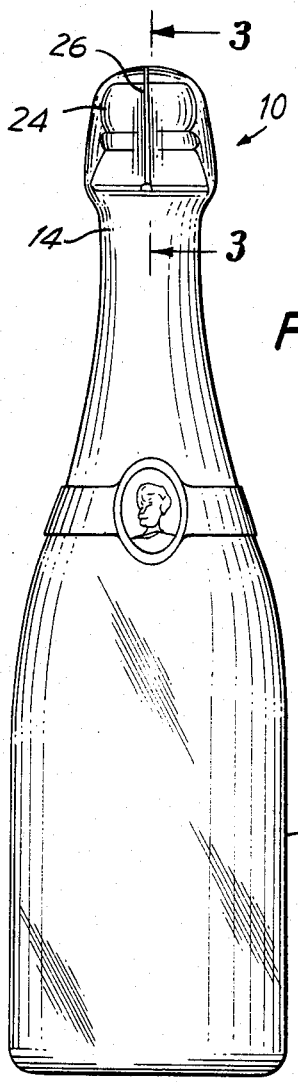
FIG. 2
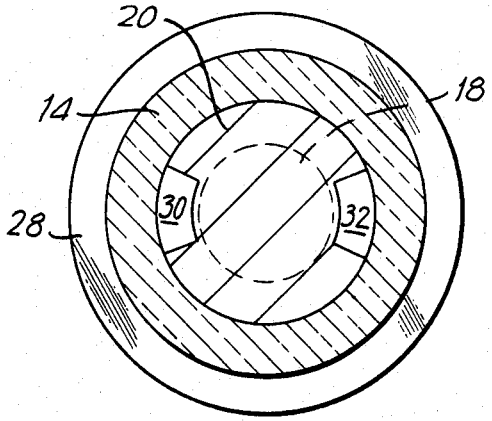
FIG. 5

SAFETY CLOSURE FOR USE IN CONJUNCTION WITH BOTTLING OF CHAMPAGNE AND OTHER SPARKLING WINES

BACKGROUND OF THE INVENTION

The present invention pertains to a new and novel safety closure device for bottles containing champagne or other sparkling wine.

The present day cork closure for a bottle of champagne or other sparkling wine must engage the interior cylindrical neck of the bottle in a conformal compression fit in order to provide the requisite airtight and leakproof sealing of the contents of the bottle. The process of uncorking a properly closed bottle of sparkling wine is normally accompanied by the familiar popping sound. This aural pleasure is one of the many which is associated with the drinking of champagne and other sparkling wines. The uncorking of the closure member may also be accompanied by the explosive propulsion thereof from the neck of the bottle with the attendant possibility of emotional fright, risk of substantial personal injury and, lastly, the chance of damage to surrounding objects.

The use of an external device such as a cage, wire mesh, net, string, bag, or the like, to catch or impede the explosively expelled cork has various disadvantages. From the marketing viewpoint of maintaining an outer package having a traditional character, external devices may present an unsightly package that takes away from the traditional image of a champagne bottle and may make a consumer believe that the product has been altered or somehow modified. Additionally, the opening of a sparkling wine bottle is already difficult, requiring peeling off a heavy foil, untwisting and releasing of a wire cage and, finally, twisting a tightly held cork in order to release it from the bottle. Any additional external attachment will make cork removal even more difficult. Moreover, there is the cost of another separate part to be added to the package which consists of the part itself, the additional time and labor to install the part, and the capital expense of building and installing the packaging machinery. Presently, there are basically two materials which are used to seal sparkling wine or champagne within a bottle. Both materials have very low densities, and consequently, very low mass. These materials are cork and polyethylene.

Cork, a natural product from the bark of a species of oak tree, *Quercus suber,* is grown in Spain, Portugal, Italy, Algeria, Morocco, Tunisia and to a limited extent in the United States. Cork, which has been used for hundreds of years, has all the attributes of a perfect closure for wine bottles and is used on all the premium and super premium brands of sparkling wine as well as the majority of all the less expensive sparkling wines produced in the world. Cork's major disadvantage is its diminishing supply and the accompanying high unit price. Consequently, a unique and clever procedure has been developed to produce champagne corks from granulated cork particles, which, when mixed with an inert binder, are extruded in continuous lengths. To satisfy the stringent specifications of the producers of premium champagne and sparkling wine, two or three natural cork discs, each about one-quarter inch thick, are glued to the particle cork on the end that comes into contact with the wine.

Polyethylene is an inert, tough, flexible plastic that can be easily formed by injection molding. Polyethylene is most often used for the low-priced sparkling wines because of its low material cost, ease and cheapness of production, ease of insertion and high speed bottling line production capability. Its major disadvantages are its inherent gas permeability, which limits its long-term sealing ability, and its public image as a non-premium closure.

Thus, it is desirable to provide a closure which provides a traditional appearance and the traditional popping sound associated with uncorking, while dissipating the closure propulsion force also associated with uncorking but which does not require the use of additional external attachments to the bottle.

The typical bottle for champagne or sparkling wine is provided with a neck having a substantially cylindrical portion which the closure is designed to seal. The body of the bottle is also cylindrical but has a much larger inner diameter than the inner diameter of the cylindrical portion of the neck and is attached to the neck by a tapered or conical portion.

The closure member of the present invention is designed for use with the typical type of bottle and takes advantage of the inherent structural design of the neck and tapered portions.

SUMMARY OF THE INVENTION

The invention provides a closure member, preferably a cork member, for champagne and sparkling wine bottles which member includes a base portion which engages the bottle wall at its neck after the sealing portion of the cork member is removed and clears the rim of the bottle. Additionally, means are provided to permit escape of gas from within the bottle when the cork is initially pulled out, for example through apertures formed in the base portion of the cork member. Thus, the cork will "pop" after the sealing portion clears the neck but will be restrained from being explosively propelled outwardly from the bottle by means of the base portion which engages the neck wall after the sealing portion has removedly cleared the rim of the bottle.

Accordingly, it is the primary object of the present invention to provide a new and novel closure member for corking sparkling wine bottles which seals the wine and upon uncorking permits the safe and expeditious discharge of pressurized gas, with accompanying popping, and selective safe removal of the closure member.

It is another object of the present invention to provide a closure member as aforesaid which is fabricated having a head portion, a base portion and a reduced shank portion therebetween, with the base portion including gas pervious means.

It is a further object of the present invention to provide a closure member of the foregoing type wherein the lateral dimensions of the head and base portions when disposed within the bottle are substantially equal.

It is yet another object of the present invention to provide a closure member of the foregoing type which is fabricated from a preselected plastic material.

It is still another object of the present invention to provide a closure member of the aforesaid type wherein the base portion is preselected to have a conformal or nonconformal geometric configuration with that of the head portion and is provided with apertures to permit the passage of gas therethrough and which base portion functionally engages the neck of the bottle concomitantly with the passage of gas through the apertures.

BRIEF DESCRIPTION OF THE DRAWINGS

The foregoing and other objects, features and advantages of the present invention will become abundantly apparent from the detailed descriptions hereinafter considered in conjunction with the accompanying drawings wherein:

FIG. 1 is a partial exploded perspective view of the cork closure member for sealing the neck of a sparkling wine bottle fabricated in accordance with the principles of the present invention pursuant to a first embodiment thereof;

FIG. 2 is a front elevational view of a bottle of sparkling wine which is sealed by means of the closure member depicted in FIG. 1;

FIG. 5 is a sectional view taken on the line 5—5 of FIG. 4;

DETAILED DESCRIPTION OF THE PREFERRED EMBODIMENTS

Figure 3:
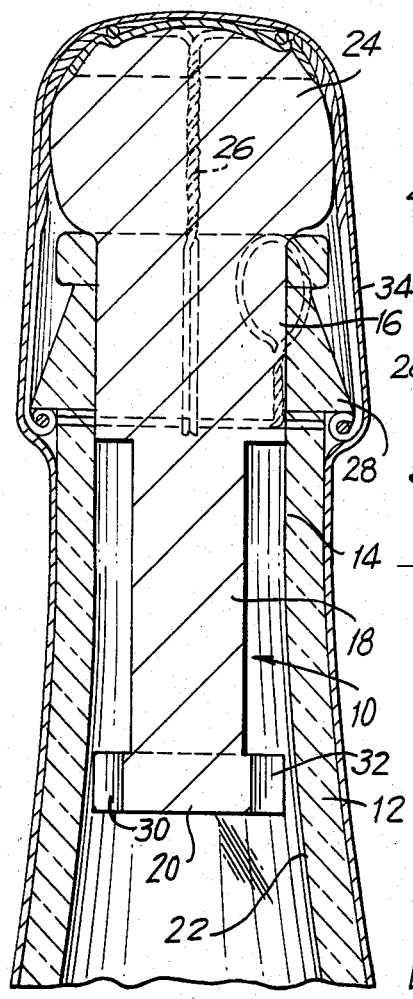
FIG. 3 is a sectional view taken on the line 3—3 of FIG. 2 depicting the sealed neck of the sparkling wine bottle.

Referring now to the drawings, and more particularly to FIGS. 1–6 thereof, there is shown a closure member generally designated by the reference numeral 10 and constructed in accordance with the preferred embodiment of the present invention. The closure member 10 is adapted to seal a champagne or similar sparkling wine bottle 12 within which the wine becomes pressurized. The closure member 10 is fabricated entirely of cork and is intended to seal the neck 14 of the bottle 12. The cork closure member comprises a head portion 16, a stem or shank portion 18 and a base portion 20.

When it is desired to seal the neck 14 a compressive device (not shown) compresses both the head portion 16 and base portion 20 in a radially inward direction. The base portion is compressed sufficiently to permit the same to be inserted through the neck of the bottle downwardly within the tapered portion 22 of the bottle 12. In this position (FIG. 3), base portion 20 re-expands and has an effective diameter which is substantially equal to that of the adjacent tapered portion 22 of the bottle but slightly greater than that of cylindrical neck portion 14, the purpose of which will be explained in more detail hereinafter.

Approximately one-half to two-thirds of the lower part of head portion 16 is compressed radially inward from an effective diameter of approximately one and one quarter inches to three eighths of an inch. The compressed part of the head portion is then inserted into neck 14 of bottle 12, as best depicted in FIG. 3, and then permitted to re-expand to the inner dimension of the neck 14, approximately five eighths of an inch. This compressive engagement of head portion 16 within neck 14 provides the sealing thereof to prevent the entry of air into the bottle or the egress of gas from within the bottle.

Having thus sealed the bottle 12, it is necessary to prevent against accidental dislodgement and premature expulsion of the cork closure 10 from the neck 14. In order to accomplish the foregoing, a wire mesh cage 26 is placed upon the upper part 24 of head portion 16 and secured in abutting engagement to the underneath surface of outwardly flared neck portion 28, in a manner well known in the art. The compressive mechanical force imparted to the closure member 10 causes the upper head part 24 to become deformed and take on a bulbous contour.

The base portion 20 is provided with a pair of cutouts 30 and 32 of a configuration best illustrated in FIG. 5. The cut-outs may have any one of a plurality of geometric configurations and the number of cut-outs may be increased; however, it is deemed preferable to have at least two cut-outs.

Figure 4:
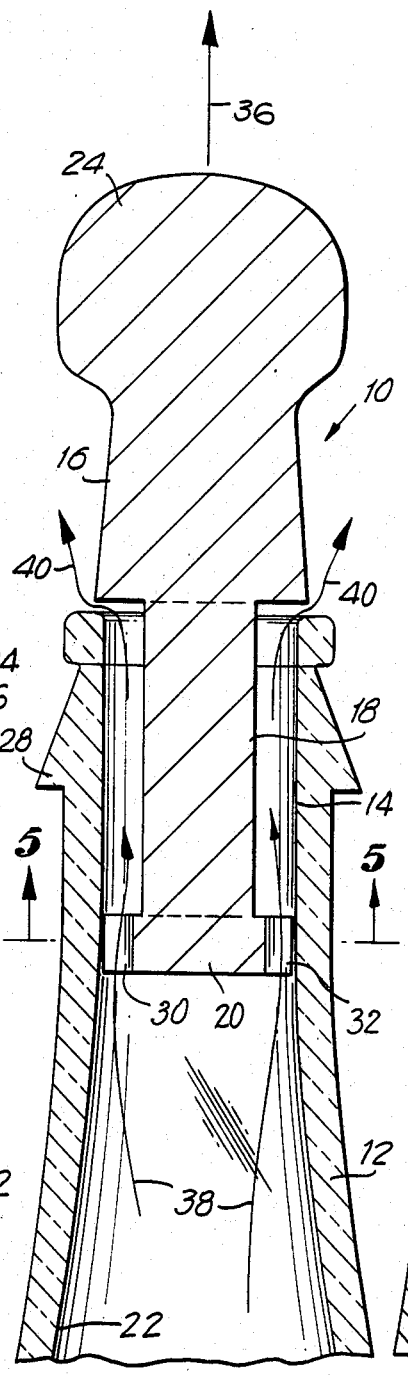
FIG. 4 is a sectional view, similar to FIG. 3 depicting the neck of the sparkling wine bottle after initial opening and gas expulsion but prior to the removal of the closure member.
Figure 6:
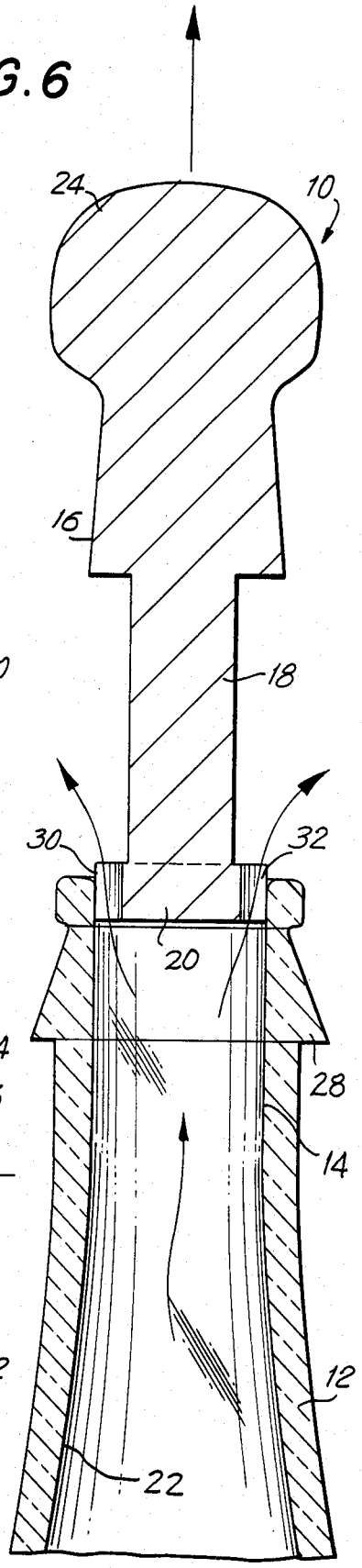
FIG. 6 is a sectional view, similar to FIG. 4, depicting the neck of the sparkling wine bottle upon removal of the closure member.

When it is desired to open (uncork) the bottle of champagne or sparkling wine 12 the foil covering 34 is removed to thereby expose the wire mesh cage 26 which is then removed. A person then commences the actual uncorking operation by pulling upwardly on upper head part 24 while concomitantly slightly rotating the same. Upon commencement of the removal of head portion 16 from its conformal relationship with the interior of neck 14, the pressurized gas within the bottle (upwardly of six times atmospheric pressure) forces the closure member 10 to be propelled upwardly in the direction indicated by arrow 36 (FIG. 4). In so doing the pressurized gas within the bottle is expelled outwardly into the atmosphere by initially passing through the cut-outs 30 and 32, in the direction indicated by arrows 38, thence upwardly around the perimeter of cylindrical shank portion 18, and then with enormous velocity and attendant shock wave, exhausts into the atmosphere, as indicated by arrows 40; and in so doing causes the familiar "pop" associated with the opening of a bottle of sparkling wine.

The upward passage and dissipation of the gas from within the confines of the bottle 12, causes the base portion 20 to be forced upwardly from within tapered portion 22 into neck portion 14; however since the diameter of base portion 20 is slightly larger than that of neck portion 14, the base portion frictionally engages the interior of neck portion 14, thereby preventing the forcible propulsion of the closure member 10 outwardly of bottle 12. Thereafter, when the closure member 10 has come to rest (FIG. 6), there being substantial pressure equilibrium on both the head portion 16 and base portion 20, it can be removed from the upper end of neck portion 14 without the previously encountered forcible ejection syndrome. In this manner, the person who opens the bottle is assured against possible pain and injury.

It will thus be readily apparent to those skilled in the art that the new and novel closure member construction is relatively inexpensive, yet safe and reliable so as to prevent accident and injury by requiring a complete second manual operation to entirely remove the closure member from the neck of the bottle.

Figure 7:
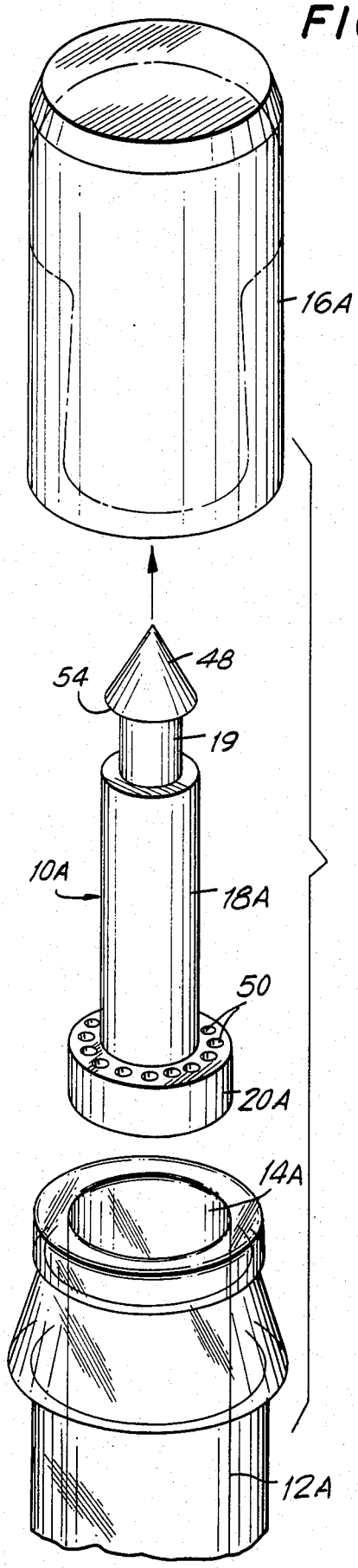
FIG. 7 is a partial exploded perspective view of a closure member for sealing the neck of a sparkling wine bottle constructed in accordance with a second embodiment of the present invention and which employs both cork and plastic as members thereof.
Figure 8:
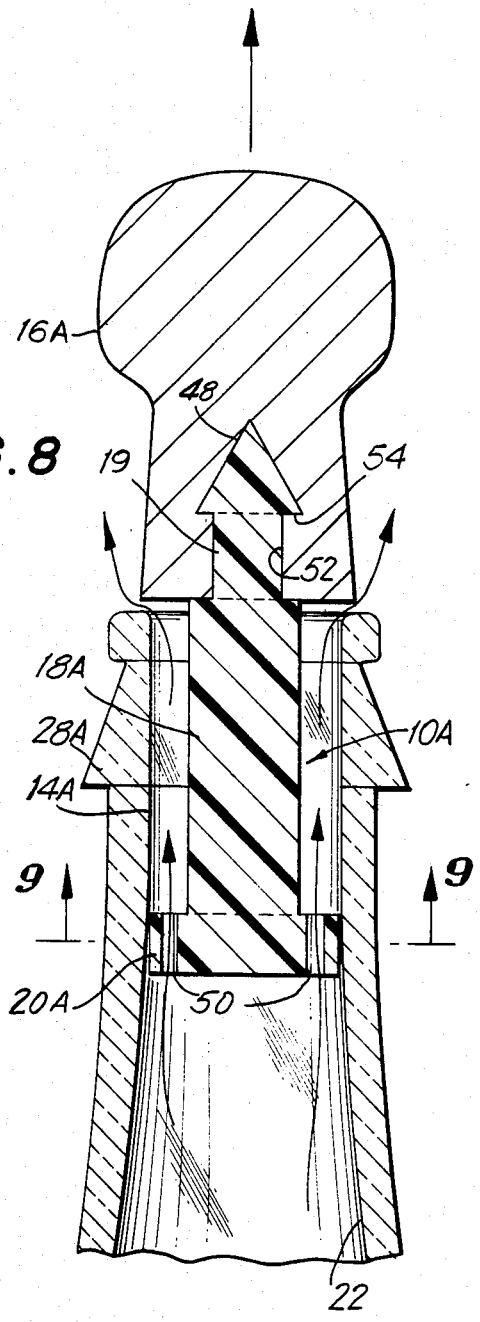
FIG. 8 is a sectional view, similar in context to FIG. 4 depicting the neck of the sparkling wine bottle after the initial gas expulsion and prior to the removal of the composite closure member illustrated in FIG. 7.
Figure 9:
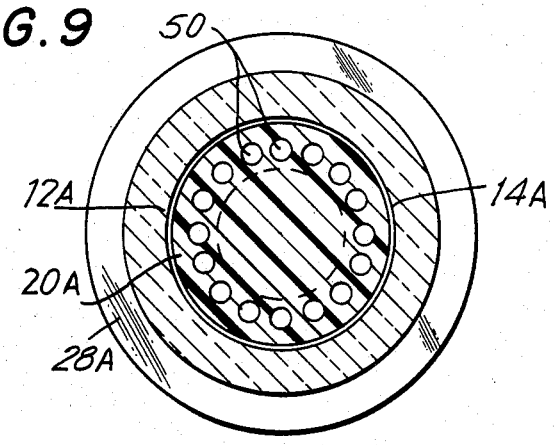
FIG. 9 is a sectional view taken on the line 9—9 of FIG. 8

A second embodiment of the present invention is depicted in FIGS. 7 through 9, wherein similar parts are denoted by similar reference numerals. In this embodiment the closure member 10A is fabricated from a combination of cork and plastic material, such as polyethylene. However, it will be appreciated by those skilled in the art that the construction hereof is equally applicable to an all cork fabrication.

The closure member 10A includes a cork head portion 16A. The remaining portions of the closure member are fabricated from polyethylene and include a shank portion 18A and a base portion 20A. The shank portion 18A includes a reduced shank member 19 which terminates in a conical upper end protuberance 48. The base portion 20A is provided with a plurality of vertically extending holes or cylindrical bores 50 which serve the same function as cut-outs 30 and 32, discussed in conjunction with the first embodiment of the present invention.

The head portion 16A is provided with a centrally disposed inner bore 52 into which is force fitted the reduced shank member 19, so as to create a mating engagement. In this regard the diameter of shank member 19 is slightly larger than that of the diamter of bore 52, such that the insertion of protuberance 48 into bore 52 causes the forced expansion thereof. Threafter, the protuberance 48 is forced into the cork structure above the bore with the flared peripheral underside 54 thereof being disposed about the upper perimeter of bore 52, to thereby prevent the separation of the cork head portion 16A from the remainder of the polytheylene construction components. Also, the elasticity of the cork causes the material surrounding bore 52 to frictionally engage shank member 19 to thereby prevent any lateral play or rotational movement of the polyethylene shank portion 18A, and thus of integrally formed base 20A, with respect to the cork head portion 16A. The base portion 20A, although formed of polyethylene, is compressible and expansible so as to function in the manner described previously with regard to base portion 20 for initial insertion and subsequent removal from neck 14A. It should be noted that the peripherally disposed bores 50 aid in effecting this desired functionality of the base portion 20A.

Figure 10:
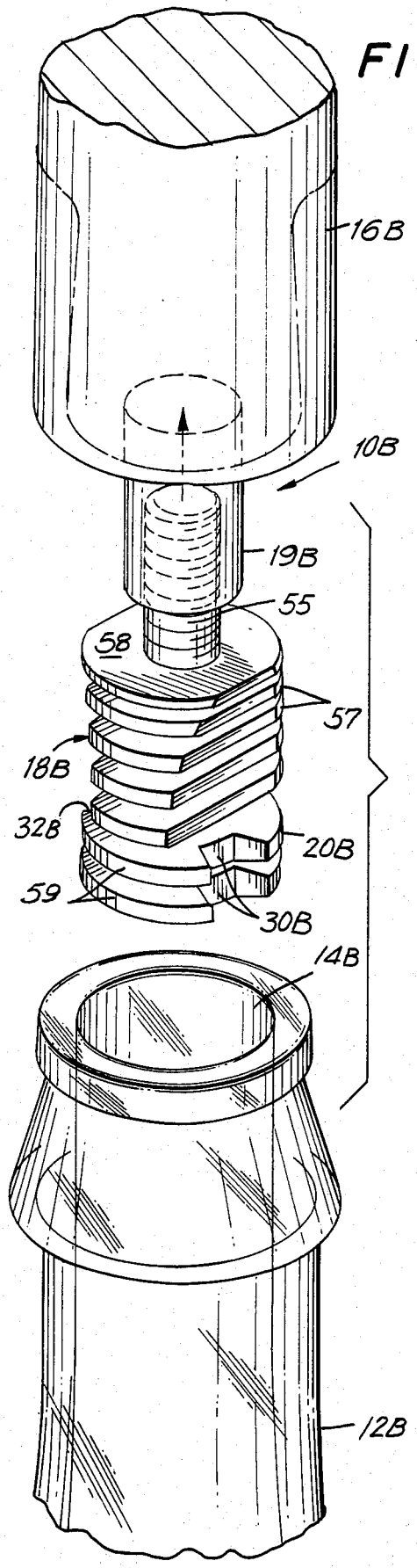
FIG. 10 is a partial exploded perspective view of a closure member for sealing the neck of a sparkling wine bottle fabricated pursuant to a third embodiment of the present invention, utilizing both cork and plastic members.
Figure 11:
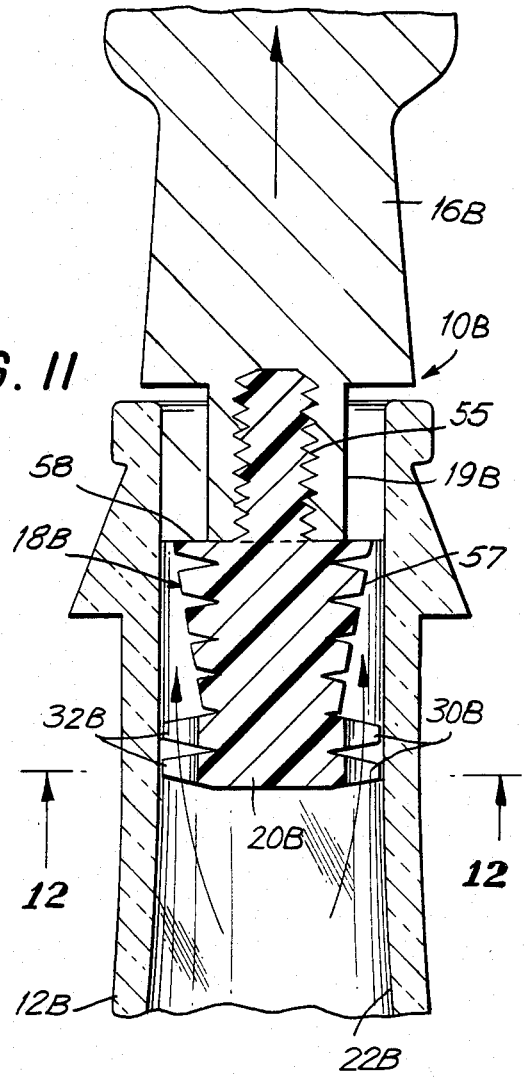
FIG. 11 is a sectional view of the construction of FIG. 10 depicting the neck of the bottle after the initial opening and expulsion of gas from within the bottle, but prior to the removal of the closure member from the bottle.
Figure 12:
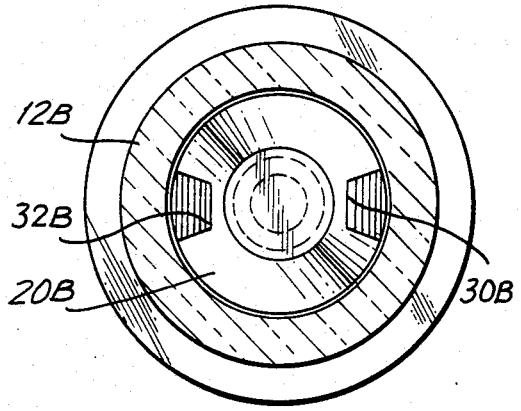
FIG. 12 is a sectional view taken on the line 12—12 of FIG. 11.

A third embodiment of the present invention is illustrated in the FIGS. 10 through 12 and similar parts are denoted by similar reference characteristics. The present embodiment depicts a closure member 10B which is fabricated partly of cork and partly of polyethylene plastic material. The closure member 10B comprises a head portion 16B having a depending shank member 19B, both of which are fabricted from cork. The remainder of the closure member is fabricated of polyethylene and comprises a base portion 20B and a shank portion generally designated by the reference numeral 18B. Extending upwardly from the top of the shank portion 18B is a threaded member 55, the purpose of which will be described in more detail hereinafter. The shank portion 18B has a substantially conical configuration and comprises a plurality of truncated radial fins 57, the most upper one 58 of which has the threaded member 50 extending therefrom. The base portion 20B comprises a pair of radial fins 59 each of which has cut-outs 30B and 32B formed therein.

The depending shank member 19B includes an internally threaded bore 56 which threadedly engages member 55 so as to secure the cork construction 16B and 19B with respect to the polyethylene construction 18B and 20B, to thereby form the entire closure member 10B. This construction provides a closure member which will permit the escape of gas outwardly of the bottle 12B after the initial removal of the closure member 10B, together with the accompanying "pop", and thereafter provides for the entire and safe removal of the closure member 10B by manual extraction of the base portion 20B from the neck of the bottle 14B, after the expulsion of the pressurized gas from within the bottle 12B. As was described previously herein, the frictional securement of the base 20B within the neck 14B prevents the forcible expulsion of the closure member 10B from the neck of the bottle 14B, thereby preventing any property damage or personal injury to the opener of the bottle or any persons in the immediately surrounding environment.

Figure 13:
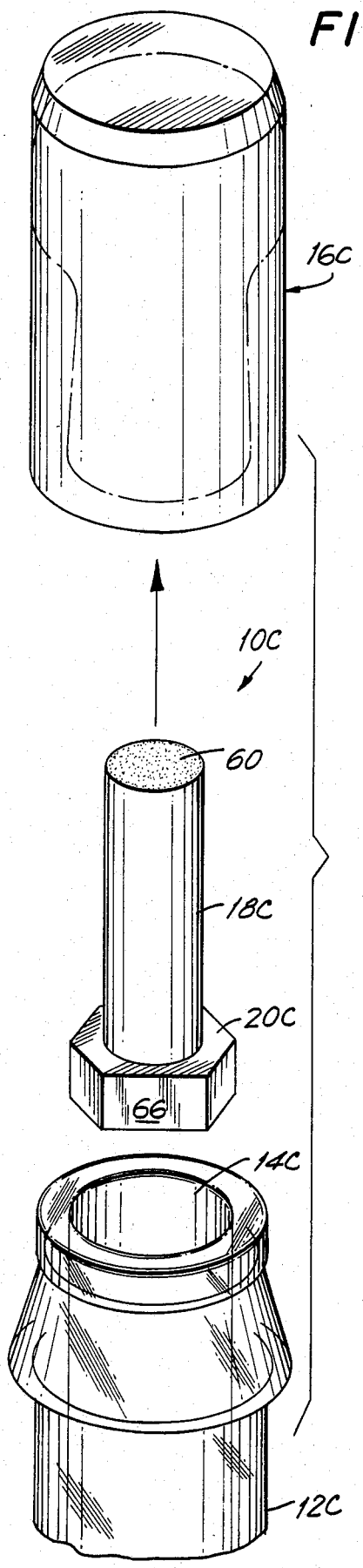
FIG. 13 is a partial exploded perspective view illustrating a closure member fabricated in accordance with a fourth embodiment of the present invention.
Figure 14:
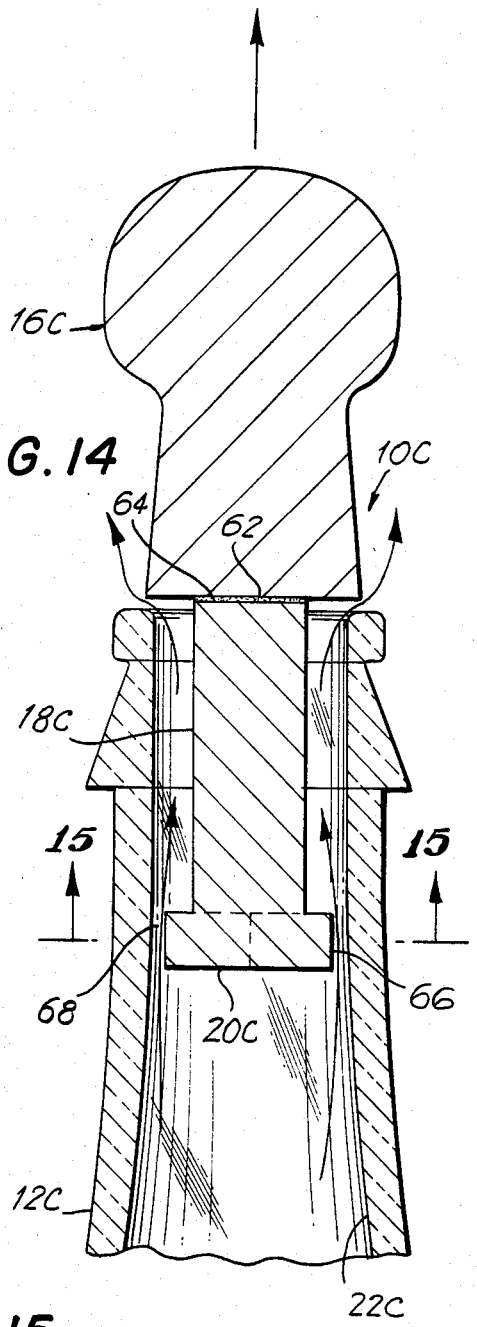
FIG. 14 is a sectional view, similar to that of FIG. 11, depicting the closure member of FIG. 13 immediately after the initial opening and during the gas expulsion phase ("popping") but prior to the actual removal of the closure member from the neck of the bottle.
Figure 15:
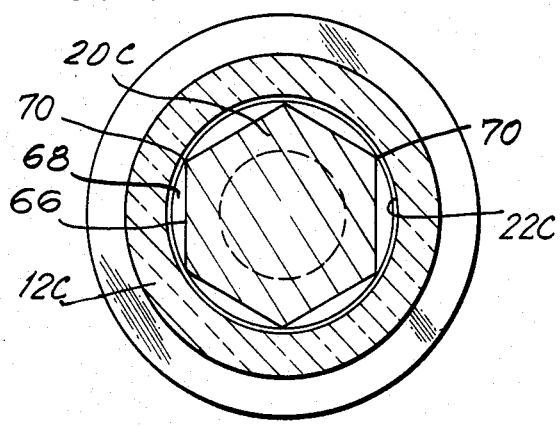
FIG. 15 is a sectional view taken on the line 15—15 of FIG. 14.

The fourth embodiment of the present invention is illustrated by FIGS. 13 to 15 herein. Again, similar parts are designated by similar reference numerals. In this embodiment, the entire closure member 10C is fabricated from cork and includes a head portion 16C, a shank portion 18C and a base portion 20C. The upper surface 60 of the shank portion 18C is secured to the centrally disposed underside 62 of head portion 16C, such as by glue 64 or by any other similarly suited adhesive bonding agent.

The base portion 20C is of hexagonal configuration and has a lateral dimension slightly greater than the effective diameter of neck 14C of the sparkling wine bottle 12C. The flats or sides 66 of the hexagonal base portion 20C, in conjunction with the circular configuration of the tapered portion 22C of the sparkling wine bottle, form spaces 68 similar in placement and function to the cut-outs 30 and 32, described hereinbefore in conjunction with the first embodiment of the present invention.

The apexes 70 of the hexagonal base portion 20C frictionally engage the interior portion of the neck 14C after the initial removal of the closure member 10C to thereby prevent the forcible propulsion of said cork closure member outwardly of the neck, whereafter the second manual manipulation of the head portion 16C is performed to free apexes 70 from their engagement with neck 14C and thus separate the closure member 10C from the bottle 12C.

While the base portion 20C has herein been described as having a regular polyhedron configuration; e.g., a hexagon, it is within the purview and contemplation of the present invention to provide a base portion having either regular or irregular polyhedron or other geometrical configurations. In this regard, the geometrical configuration is dependent upon the base having portions capable of frictional engagement with the neck of the bottle, and portions adjacently contiguous therewith which are recessed with respect to the neck, so as to provide cut-outs or gas permeable passages through the base portion.

Figure 16:
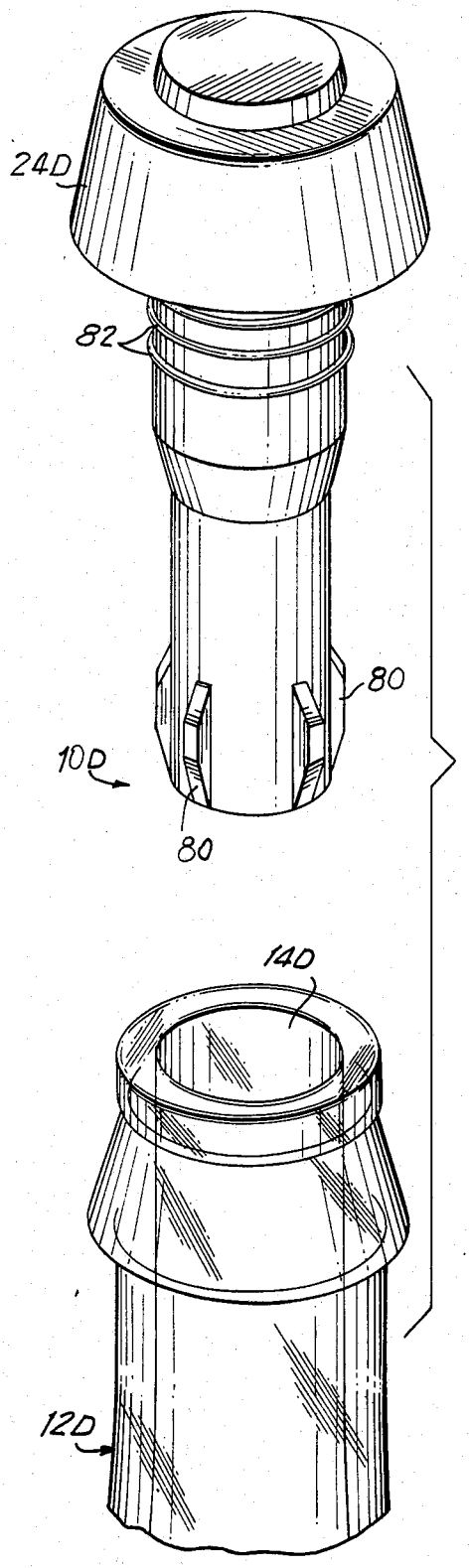
FIG. 16 is a partial exploded perspective view illustrating a closure member which is constructed in accordance with a fifth embodiment of the present invention and fabricated entirely of plastic.
Figure 17:
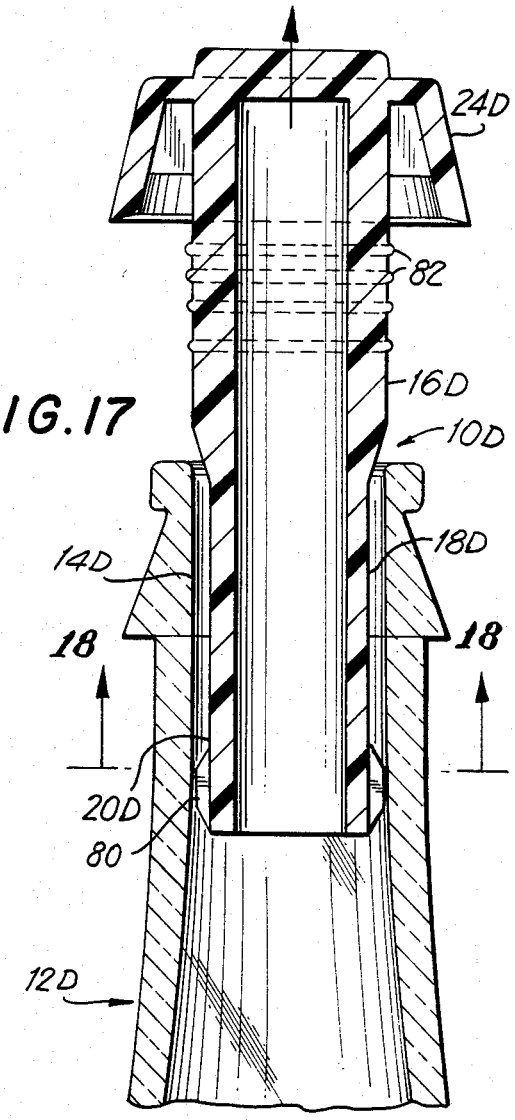
FIG. 17 is a sectional view depicting the closure member of FIG. 16 after the gas expulsion phase and immediately prior to the removal of the closure member from within the neck of the bottle.
Figure 18:
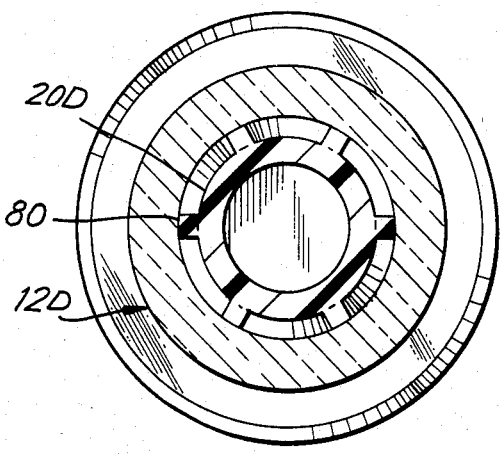
FIG. 18 is a sectional view taken on the line 18—18 of FIG. 17.

The fifth and final embodiment of the present invention is depicted by FIGS. 16 through 18, where again similar parts are denoted by similar reference numerals. The closure member 10D is completetly fabricated from polyethylene plastic material and the individual components are integrally formed to produce said composite closure member. Prior to discussion of the construction of the closure member 10D, attention is directed to the fact that this type of plastic closure member is normally employed in conjunction with inexpensive champagne and sparkling wines which are not normally intended to age further during bottle storage.

The closure member 10D includes a head portion 16D having a flared upper part 24D. The shank portion 18D terminates in the base portion 20D which comprises the lowermost part of 18D in conjunction with longitudinally disposed fins 80 disposed about the perimeter thereof. It is to be noted that although there are six individual fins depicted, the number of fins may be as low as two or three but have no definitive number as an upper limit. The head portion 16D is provided with a plurality of radial deformable bands or beads 82, the number of which is herein depicted as four.

In the operation of closure member 10D, the head portion 16D is compressively inserted within the neck 14D of the bottle 12D, such that the sealing is accomplished by the partial deformation of bands 82, whereby said deformed or compressed bands are disposed in abutting frictional engagement with the interior surface of neck 14D. Thereafter, when it is desired to remove closure member 10D from bottle 12D, the closure member is partially removed, as discussed previously, and as depicted in FIG. 17, whereby the longitudinally extending peripheral fins 80 frictionally engage the interior surface of the neck 14D, thus preventing the forcible expulsion of closure member 10D with the incumbent propensity for destruction and personal injury.

It is thus seen that I have provided a new and novel closure member for use in conjunction with the sealing of bottles of champagne and other sparkling wines which permits of the safe removal of the closure member at the time one wishes to drink the contents of the bottle. However, the improved construction, as delineated herein, while permitting the initial and familiar "pop" aesthetically associated with the drinking of champagne and sparkling wines, prohibits the forcible expulsion of the closure member with the normal attendant proclivity of possible damage to surrounding delicate objects and/or personal injury to the occupants of the immediate environment within which the bottle is situated. When it is desired to completely remove the closure member, a second manual operation is performed which provides for the removal of the closure member but only after an ambient and equalized pressure condition on the closure member has been attained.

It will be apparent to those skilled in the art that there are attendant changes, improvements and modifications which may be made in the present structual configurations without departing from the spirit and scope of the invention, as defined in the appended claims.

What is claimed is:

1. A safety closure in combination with a sparkling wine bottle,
- said wine bottle including a neck,
- said safety closure being adapted for insertion into the neck of said wine bottle,
- said safety closure comprising
  - a head portion,
  - a base portion, and
  - a shank portion,
- said shank portion being interposed between said head portion and said base portion,
- said base portion including means for permitting the passage of gas therebeneath upwardly thereabove when said closure is disposed within said bottle, and
- said base portion having a lateral dimension slightly larger than that of said neck of said sparkling wine bottle.

2. A safety closure with a sparkling wine bottle in accordance with claim 1, wherein
- said gas passage means of said base portion comprises gas pervious means.

3. A safety closure with a sparkling wine bottle in accordance with claim 2, wherein
- said gas pervious means comprises cut-outs formed in said base portion.

4. A safety closure with a sparkling wine bottle in accordance with claim 2, wherein
- said base portion has a substantially conformal configuration with that of said neck of said sparkling wine bottle.

5. A safety closure with a sparkling wine bottle in accordance with claim 4, wherein
- said gas pervious means comprises a plurality of bores formed in said base position.

6. A safety closure with a sparkling wine bottle in accordance with claim 5, wherein
- said bores are vertically disposed in substantially parallel relationship with the longitudinal axes of said safety closure and said sparkling wine bottle.

7. A safety closure with a sparkling wine bottle in accordance with claim 2, wherein
- said gas pervious means comprises at least two substantially vertically disposed cut-outs disposed in spaced apart relationship.

8. A safety closure with a sparkling wine bottle in accordance with claim 2, wherein
- said gas pervious means comprises a plurality of substantially vertically disposed bores in radially extending and spaced apart relationship.

9. A safety closure with a sparkling wine bottle in accordance with claim 2, wherein said gas pervious means comprises at least two members disposed in spaced apart relationship extending radially outwardly of said base portion.

10. A safety closure with a sparkling wine bottle in accordance with claim 9, wherein said two radially outwardly extending members are vertically oriented fins disposed in substantially parallel relationship with the longitudinal axes of said safety closure and said sparkling wine bottle.

11. A safety closure with a sparkling wine bottle in accordance wth claim 2, wherein said base portion has a non-conformal configuration with respect to said neck of said sparkling wine bottle, and said non-conformal geometric configuration in conjunction with said neck form said gas pervious means.

12. A safety closure with a sparkling wine bottle in accordance with claim 1, wherein said head, base and shank portions are fabricated from cork.

13. A safety closure with a sparkling wine bottle in accordance with claim 1, wherein said head, base and shank portions are fabricated from plastic.

14. A safety closure with a sparkling wine bottle in accordance with claim 1, wherein said head portion is fabricated from cork, and said shank and base portions are fabricated from a plastic material.

15. A safety closure with a sparkling wine bottle in accordance with claim 1, wherein said neck of said bottle has a circular configuration, and said base portion has a regular polyhedron configuration about which is circumscribable a circle of slightly larger diameter than that of said bottle neck.

16. A safety closure for a sparkling wine bottle of a construction including a neck of circular cross-section and a flared outwardly tapered portion extending downwardly from the neck and also of circular cross-section, said safety closure comprising, a head portion, a base portion, and a shank portion, said shank portion have a lateral dimension smaller than that of said base and head portions and being interposed therebetween, said head portion having an upper part and a lower part, said upper part being disposed outwardly of said neck of said bottle and having a lateral dimension larger than that of said neck and said lower part, said lower part of said head portion being sealingly engageably disposed within said neck of said bottle, said base portion having a lateral dimension of slightly larger cross-section than that of said neck of said bottle, said base portion including gas pervious means for permitting the passage of pressurized gas therebeneath upwardly thereabove upon the removal of said lower part of the head portion from within the neck of said bottle, and wherein the passage of pressurized gas concomitantly propels said base portion upwardly to cause frictional engagement of said base portion within the neck of said bottle and the base portion being subsequently removable from the neck of said bottle upon the further upward movement of the upper part of the head portion.

* * * * *